US009049968B2

(12) United States Patent
Ellison

(10) Patent No.: US 9,049,968 B2
(45) Date of Patent: Jun. 9, 2015

(54) PEN FOR WASHING SMALL CHILDREN

(76) Inventor: Norman Ellison, Los Angeles, CA (US)

( * ) Notice: Subject to any disclaimer, the term of this patent is extended or adjusted under 35 U.S.C. 154(b) by 1008 days.

(21) Appl. No.: 12/928,810

(22) Filed: Dec. 20, 2010

(65) Prior Publication Data

US 2012/0151668 A1 Jun. 21, 2012

(51) Int. Cl.
*A47K 3/06* (2006.01)
*A47K 3/064* (2006.01)

(52) U.S. Cl.
CPC ..... *A47K 3/064* (2013.01)

(58) Field of Classification Search
CPC ..... A47K 3/06; A47K 3/064
USPC ..... 4/572.1, 584–587; 5/93.1, 98.1
See application file for complete search history.

(56) References Cited

U.S. PATENT DOCUMENTS

| | | | | | |
|---|---|---|---|---|---|
| 321,217 | A | * | 6/1885 | Hayward | 4/587 |
| 1,075,912 | A | * | 10/1913 | Helli | 4/587 |
| 1,422,718 | A | | 7/1922 | Keehn | |
| 1,444,487 | A | * | 2/1923 | Volters | 4/587 |
| 1,726,752 | A | * | 9/1929 | Mirkin | 4/586 |
| 1,867,673 | A | * | 7/1932 | McCandless | 4/586 |
| 2,581,883 | A | | 1/1952 | Rechler | |
| 2,602,170 | A | * | 7/1952 | Keck | 5/98.1 |
| 2,698,948 | A | | 1/1955 | Levitt | |
| 2,784,420 | A | * | 3/1957 | Moltane | 5/98.1 |
| 3,799,228 | A | * | 3/1974 | Crawford | 4/587 |
| 3,882,553 | A | | 5/1975 | Poiencot | |
| 4,602,392 | A | | 7/1986 | Grier | |
| 5,033,131 | A | | 7/1991 | Paden | |
| 5,077,842 | A | * | 1/1992 | Horne, Jr. | 4/585 |
| 5,491,850 | A | | 2/1996 | Kiester | |
| 5,809,588 | A | | 9/1998 | Angelotti | |
| 6,158,065 | A | | 12/2000 | Tuoriniemi | |
| 7,032,259 | B1 | | 4/2006 | Kilion | |

* cited by examiner

*Primary Examiner* — Tuan N Nguyen
(74) *Attorney, Agent, or Firm* — The Law Office of Scot S. Fagerland

(57) ABSTRACT

A pen for washing a small child, intended for use in a shower or bathtub. The floor panel is flat, resilient for the comfort and safety of the child, and perforated to allow water to flow through. The upper frame assembly provides a handrail too high for the child to trip, fall, or climb over, but low enough for the child to comfortably hold itself upright or pull itself to a standing position. Smooth, perforated side panels allow free flow of water while safely confining the child to the interior of the pen. For use in bathing, the pen relies on the surrounding bathtub to hold water. For use in showering, the pen retains no water. The pen may be collapsible for easy storage.

2 Claims, 10 Drawing Sheets

PEN FOR WASHING SMALL CHILDREN

BACKGROUND OF THE INVENTION

This invention relates generally to the field of bathing apparatuses for small children.

The bathing of small children has long been a stressful and inconvenient task for parents or other adult attendants. Infants are typically unable to lift their heads or control their movements well enough to allow any freedom around water. Toddlers can sit, stand, move around and play during bath time. Despite this capability and desire, they haven't mastered balance or learned how to navigate the hard and slippery surfaces of conventional bath tubs and showers. Many types of bathing units attempt to control these children using straps or a variety of shaped enclosures that physically constrain the child to remain in a predetermined position. This often creates a more stressful bathing experience for both child and parent or attendant.

Additionally, there are situations when a parent would like to shower or bathe him or herself but has difficulty finding the opportunity if alone with a small child. Even if the child is sleeping in a crib, the parent will want to bathe quickly while trying to listen for the child should he need attention. If the child is awake, she may not be content or it may be unsafe for the child to be left alone while the adult bathes. In these situations, it would be convenient to bring the child into the shower or bath with the parent in a way that allows the parent the freedom to bathe without concern for the safety of the child. With all existing prior art, a parent attempting to shower or bathe with their child needs to be constantly vigilant and usually hold or restrain the child which makes bathing oneself stressful and difficult.

Paden, in U.S. Pat. No. 5,033,131, discloses an enclosed platform in which an infant can stand during showering. This structure has three particular shortcomings or differences from the present invention. First, the configuration of the platform is designed to keep the infant upright. In particular, the lower region of the platform is tapered to disallow a great range of foot movement. Therefore, the platform is too small for the child to sit or play in. Second, the walls of the platform are designed to be shorter than the infant, at the height where the child could grasp the upper walls for support. (Paden Claim 1). A child could climb out of the enclosure. Third, the platform on which the child stands is a rigid surface. Water drains through small openings around the edge of this platform.

The Paden patent is also narrowed by three particular features that do not apply to the present invention. First, the container is designed to accommodate a showerhead (Paden Claim 1). Second, the container is designed to latch onto the side rail of a bathtub (Paden Claim 4). Third, the device is designed to work away from plumbing, with a self-contained water supply and drainage system.

Angelotti, U.S. Pat. No. 5,809,588, discloses a bathtub enclosure providing a large sitting area and a soft surface. The device is collapsible when not in use. However, the structure of the invention is very different from the present claimed invention, in at least three major ways. First, it consists of a sheet of water-resistant fabric, draped over the bathtub walls and supported by rods, cords, suction cups, and/or hooks. (Angelotti Claim 1). The invention therefore extends vertically no higher than the bathtub. Second, the Angelotti device does not work in a shower with no tub. Third, the invention in some embodiments could hold water, and therefore would not lessen the risk of drowning. (Angelotti Claims 2, 7, and 8)

Tuoeriniemi, in U.S. Pat. No. 6,158,065, discloses a vertical tub. The child stands in the tub, which holds water. It can be placed in the bathtub along with a parent. The dimensions of the tub are such that the child can lean backward against one side while holding on to the other stand without sitting or falling. The walls of the tub are height-adjustable. The Tuoeriniemi patent has two particular shortcomings that are overcome in the present claimed invention. First, like the Paden patent, the tub is too small for sitting or playing in. In fact, it is designed to facilitate standing only. (Claim 1). Second, the tub is intended to hold water even when not in a larger bathtub. (Claim 1).

Several other U.S. patents describe aids for bathing small children, but have fundamentally different structures from the presently claimed bathtub pen. Grier, U.S. Pat. No. 4,602,392, discloses a compact adjustable housing that fits around the body of the child reducing the space to move around in. Kiester, in U.S. Pat. No. 5,491,850, discloses a portable, hammock-type infant support system for installation in a conventional bathtub so that an infant can be supported in a prone position above the tub floor or water level while the mother is washing or bathing the infant. The support system includes a flexible foam rubber panel suspended within the tub by suction cups. It is essentially just a hammock that fits within the entire bathtub. It does not enclose the child in a pen or allow a parent to bathe with the child. In fact, it does not save the parent from any hands-on work or constant supervision.

Killion, in U.S. Pat. No. 7,032,259, and Rechler, in U.S. Pat. No. 2,581,883, disclose stand-alone tubs that hold water, with collapsible legs. Keehn (U.S. Pat. No. 1,422,718) and Levitt (U.S. Pat. No. 2,698,948) each describe a small tub that is supported on the large adult tub. Poiencot (U.S. Pat. No. 3,882,553) describes a "false bottom" situated in the full-size tub. When the infant falls onto the lower portion of the false bottom, it opens a drain and releases the water, to prevent drowning.

In summary, a search of the prior art reveals some elements of the present claimed invention, such as child-sized baths for use in an adult tub, collapsibility, a soft material protecting the child from the hard bathtub floor, and water drainage. However, each patent discloses a fundamentally different structure or purpose from the present invention. Some are free-standing tubs that hold their own water. Some are attached to the main tub. Each prior invention is designed to keep the infant in one position—whether standing, sitting, or lying—and does not allow a variety of positions. Some of them are outright restraints, not spacious and open like the present invention. None of the prior structures fully encloses and protects the child while still allowing him/her freedom of motion.

BRIEF SUMMARY OF THE INVENTION

Accordingly, several advantages of one or more aspects are as follows: to provide a safe space that allows a small child to move freely, sit, stand, and engage in water play while bathing or showering, to remove risk of child falling against any hard surface or accessing faucet valves in an existing conventional bathtub or shower, to eliminate the tripping, flipping or climbing hazard presented by the top edge or lip of another basin. to free parent or attendant from having to hold or restrain the child during bath or shower thus affording more convenience and providing parent the ability to simultaneously shower or bathe in conventional bathtub or shower while child is in washing pen, to surround the small child with sturdy hand holds and surfaces appropriate for supporting the child's weight, to provide a safe and convenient means to transition an infant from bathing in a seated or reclined position to being able to sit, stand and move about on their own when bathing or showering in a conventional bathtub or shower, to provide an appropriately sized bathing environment as opposed to the adult sized tub or shower which can intimidate small children, to provide a bathing apparatus that self drains and dries in the free air of the bathroom, and in some embodiments provide a unit that may be collapsed for easy transport or storage.

Other objects and advantages of the present invention will become apparent from the following descriptions, taken in connection with the accompanying drawings, wherein, by way of illustration and example, an embodiment of the present invention is disclosed.

The disclosed invention is a pen for bathing or showering a small child. Unlike basin or inflatable tubs, the pen allows the child free movement to sit, stand, or move about freely without danger of injury from falling or tripping. All surfaces of the pen are water permeable. Therefore, the pen does not retain water independently of a bathtub in which it sits. When used for showering, the pen prevents any danger of drowning. The pen may be collapsible for easy storage. It may alternatively be a non-collapsible structure, with either rigid or flexible side panels. In all embodiments, the floor panel of the pen is resilient, to support the child's weight and to prevent injury if the child falls within the pen. The top edge provides a handhold at an appropriate height for containing the child safely without danger of falling or climbing out.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
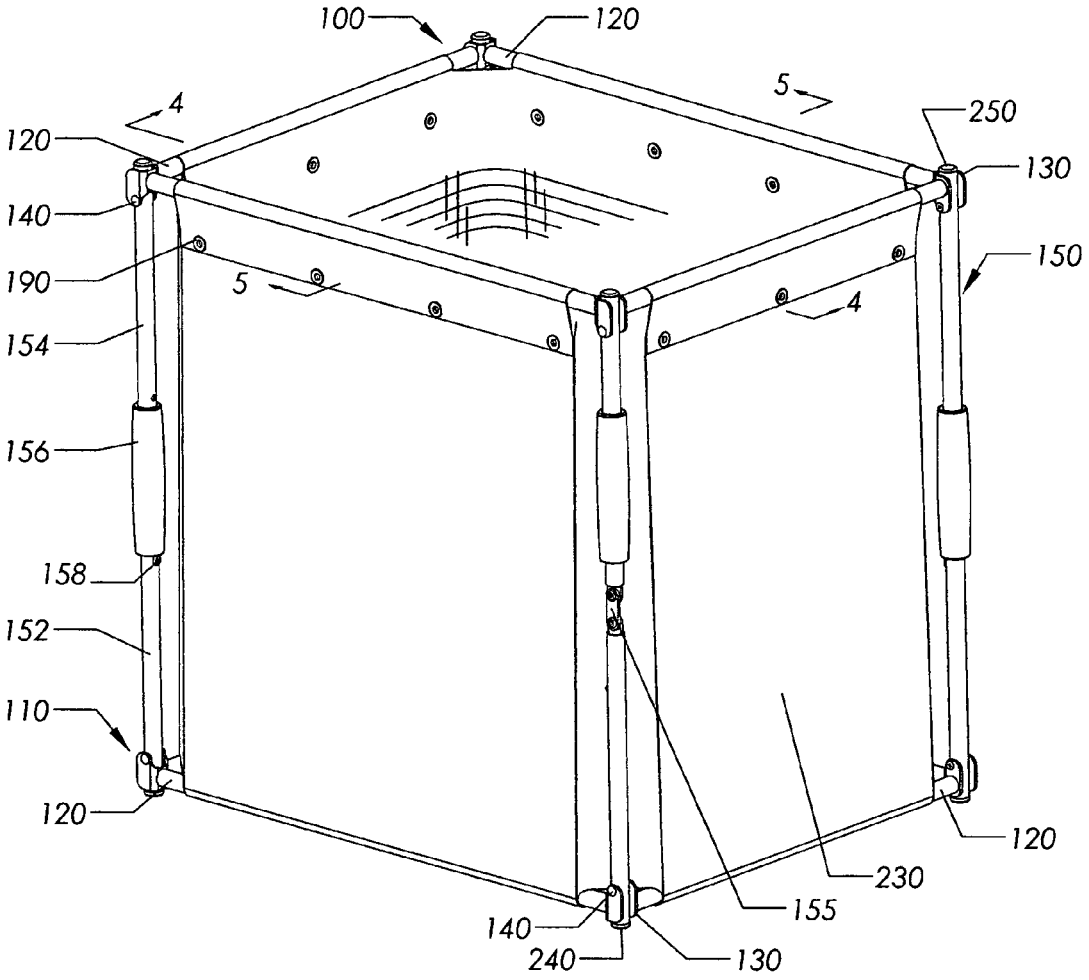
FIG. 1 is a perspective view of a first embodiment in an erected state where the pen is ready for use.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

In a first embodiment, the major features of the pen are a rectangular upper frame assembly (100), a rectangular lower frame assembly (110), one or more side panels (230), four legs (150), and a floor panel (220). The floor panel (220) is best seen in FIGS. 4-7. The other major elements of this embodiment are best viewed in FIG. 1.

As shown in FIG. 1, each frame assembly (the upper and lower) is formed of four frame members (120). At each vertex of the rectangular frame, two frame members are joined at right angles by a frame hinge bracket (130). The frame hinge brackets (130) hold the frame members (120) rigidly, not allowing for any shear motion.

Each leg (150) is formed from a lower leg (152), an upper leg (154), a hinge plate (155), and a sleeve (156). Each upper leg (154) is joined to a frame hinge bracket (130) on the upper frame assembly (100). Each upper leg (154) is joined to its frame hinge bracket (130) with pivotable attachment means (140), which allows for rotational motion of the upper leg (154) in a plane parallel to one upper frame member (120) and perpendicular to the other frame member (120) joined at the same frame hinge bracket (130).

In like manner, each lower leg (152) is also joined to a frame hinge bracket (130) on the lower frame assembly (110). Each lower leg (152) is secured to its frame hinge bracket (130) with pivotable attachment means (140), which allows for rotational motion of the lower leg (152) in a plane parallel to one lower frame member (120) and perpendicular to the other frame member (120) joined at the same frame hinge bracket (130). Each lower leg (152) has a foot (240) on bottom in order to prevent any sharp edges or scuffing of the floor. The feet (240) may take the form of suction cups to help anchor the pen in the shower or bathtub.

Figure 2:
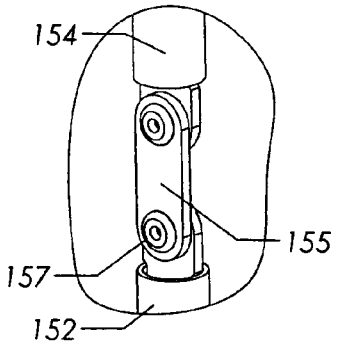
FIG. 2 is a detailed view of FIG. 1 showing a hinge.

As shown in FIG. 2, each upper leg (154) is joined to a hinge plate (155) by pivotable attachment means (157). Likewise, each lower leg (152) is joined to a hinge plate (155) by pivotable attachment means (157). The hinge plate (155) acts as a joint between the rigid upper leg (154) and lower leg (152). Each hinge plate (155) allows its upper leg (154) and lower leg (152) freedom of motion in the same plane as the frame hinge brackets (130) secured to the opposite ends of the upper legs (154) and lower legs (152).

Figure 3:
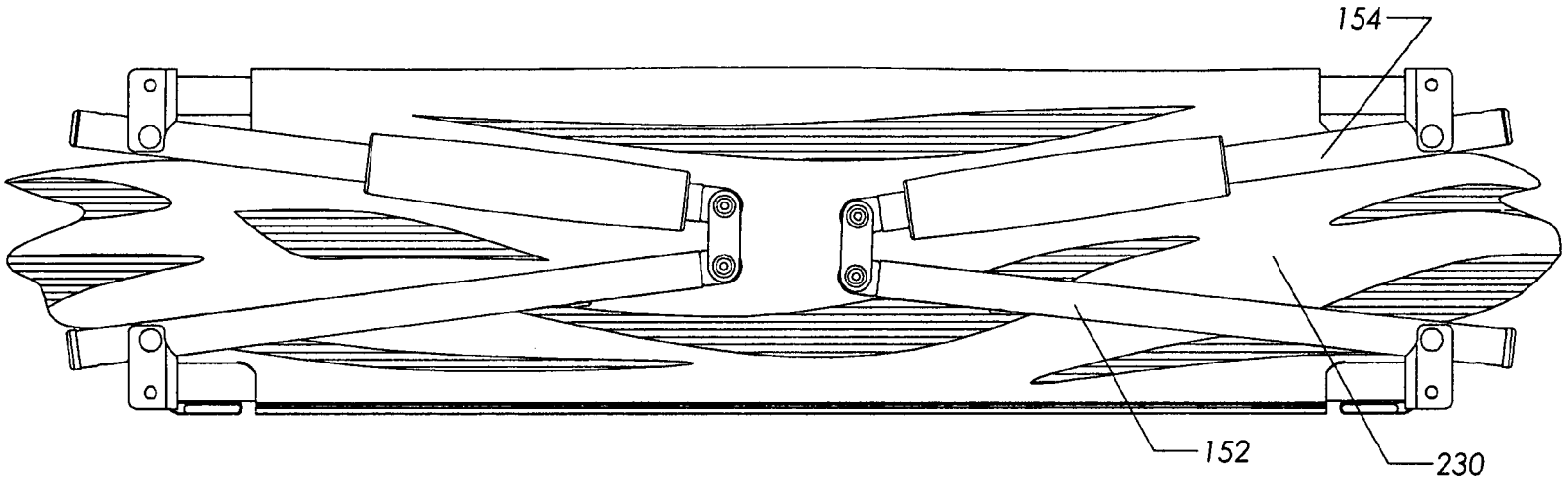
FIG. 3 is an elevation view of the first embodiment in a collapsed state.

The design of this embodiment allows the entire structure to expand to a fully upright position, such as in FIG. 1, or to collapse into a flat position as shown in FIG. 3. The pen stands in the upright position during use, and can lie in the flat position during storage. To lock the pen into upright position, each hinge plate (155) is firmly held in place by a sleeve (156), which is in turn held in place by a stop (158), such as a protrusion on the lower leg (152), as seen in FIG. 1. The sleeve on the left and right sides of FIG. 1 are seen in the upright and locked position. To collapse the pen into its flat, storage position, an adult slides the sleeve (156) up onto the upper leg (154) (as seen in the center of FIG. 1), thus freeing the leg to bend at its hinge plate (155).

The upper frame assembly (100) is intended to be a handrail at optimal height for an infant or toddler. It is too high for the child to trip, fall, or climb over, yet low enough to hold onto in a standing position. The legs (150) accordingly are the appropriate length.

Figure 4:
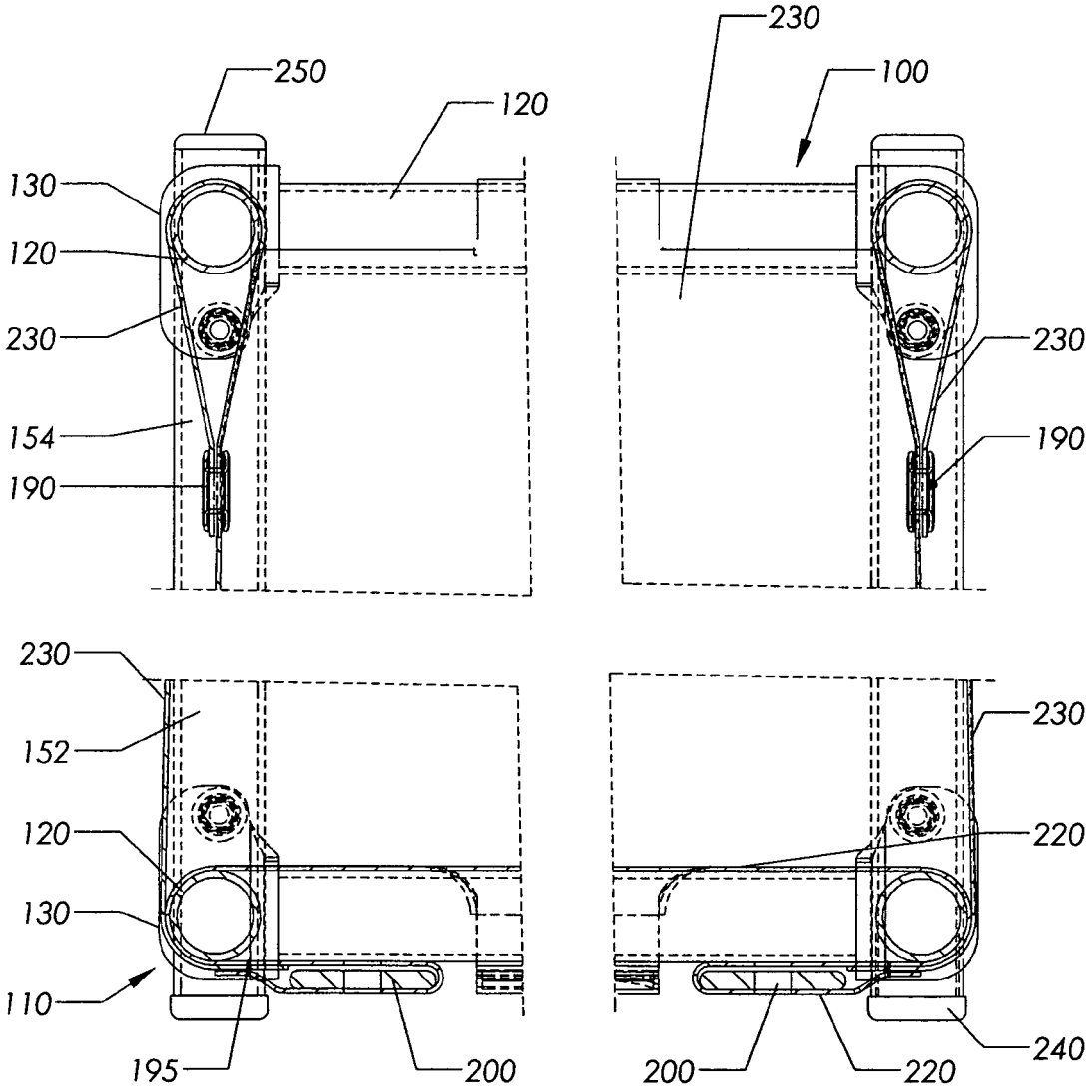
FIG. 4 is a front section view of the first embodiment in an erected state.
Figure 5:
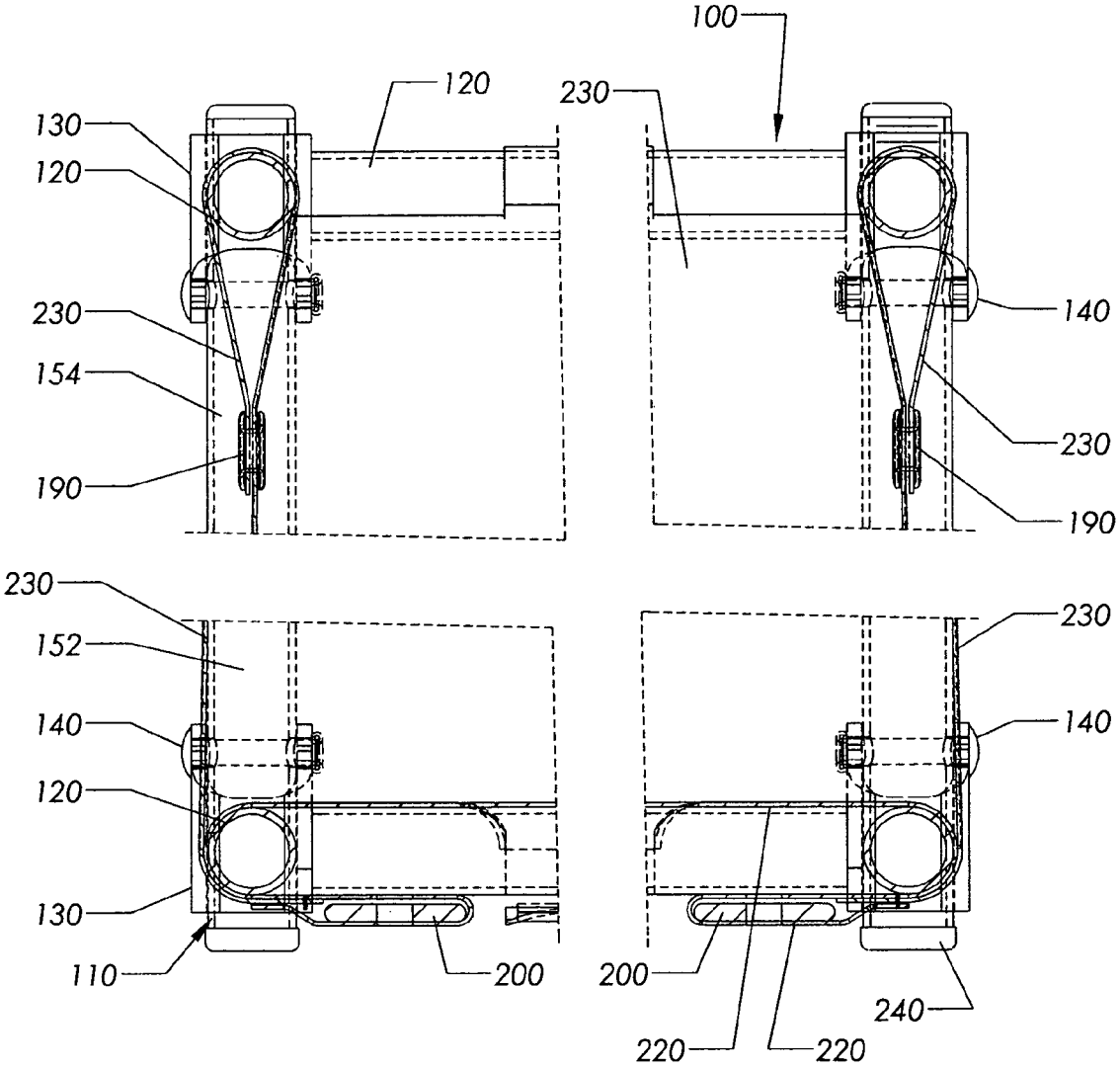
FIG. 5 is a side section view of the first embodiment in an erected state.

In the upright position, each side panel (230) is essentially as tall as each leg (150). As shown in FIGS. 1, 4, and 5, the upper end of each side panel (230) is attached to each upper frame member (120). The upper end of the side panel (230) is secured to itself by securing means (190) below the upper frame member (120). The securement means (190) may be sewing, adhesive, eyelets, drawstrings, or other means or combinations of such means. As seen in FIGS. 4 and 5, beneath the lower frame assembly (110), the lower end of each side panel (230) is secured to the floor panel (220), with securing means (195). Securing means (195) may be sewing, adhesive, eyelets, or similar means or combination of such means.

As shown in FIG. 3, each side panel (230) is flexible enough to fold when the structure is collapsed into its storage position. In this first embodiment, each side panel (230) is constructed of mesh fabric or a similar material, which allows this kind of flexibility. The material of each side panel (230) offers other advantages as well. It provides the pen with soft walls, for the safety of the child. The material is also permeable to water so that the pen cannot retain water and pose a drowning hazard. Each side panel (230) forms a continuous surface without hales or gaps large enough for a child to reach through or use as handholds or footholds to climb out of the pen.

The floor panel (220) is fashioned from a sturdy, resilient, water-permeable material such as polypropylene or a similar material. Because the floor panel (220) is permeable, it prevents air from getting trapped between the floor panel (220) and the surface of the water, which could lead to buoyancy or capsizing of the pen. The resiliency of the floor panel (220), and its separation from the hard surface of the bathtub, allows for a soft cushioned landing if the child should fall.

As shown in FIG. 4, the floor panel (220) spans the full area of the lower frame assembly (110); indeed, the floor panel (220) is wrapped over top of the lower frame members (120) as seen in FIGS. 4 and 5. This arrangement allows for a floor of maximal surface area.

Figure 6:
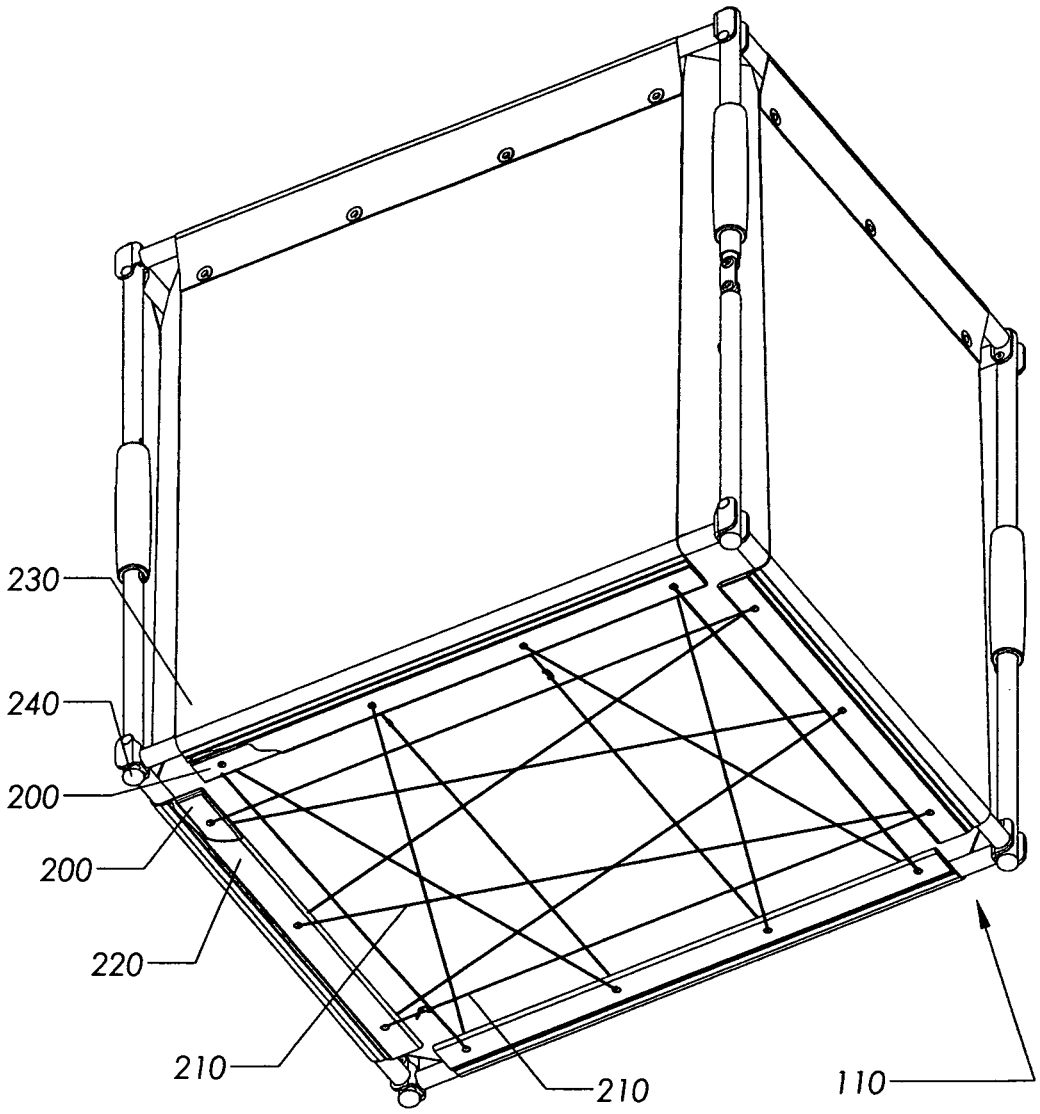
FIG. 6 is a perspective view with a partial cutaway showing the bottom of the first embodiment.
Figure 7:
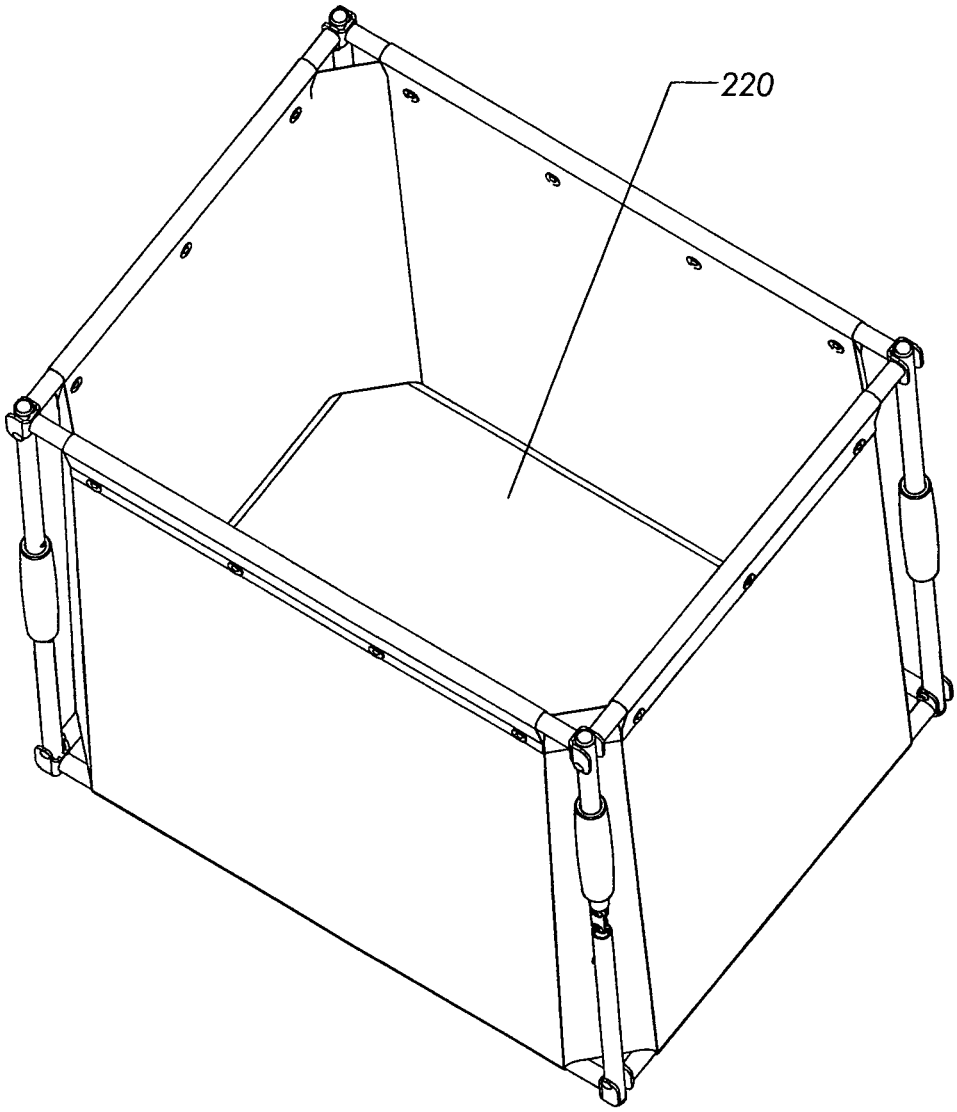
FIG. 7 is a perspective view of the embodiment in an erected state with the floor panel shown.

FIG. 6 shows a system of tensioning cords (210), which stretch taut the floor panel (220). The tensioning cords are connected to the floor panel (220) by connection means (200). In the embodiment shown in FIG. 6, each connection means (200) takes the form of a rigid bar. In this embodiment, the floor panel (220) is wrapped around the bar, and the bar is punched with holes, through which the tensioning cords (210) are looped. The connection means (200) may alternatively take the form of eyelets, webbing, clips, or other such means or combination of such means. If a child falls in the pen, he or she will fall onto the resilient floor panel (220), safely cushioned from the hard surface of the bathtub. The tensioning cords (210) also provide tension and structural integrity to each side panel (230).

Figure 8:
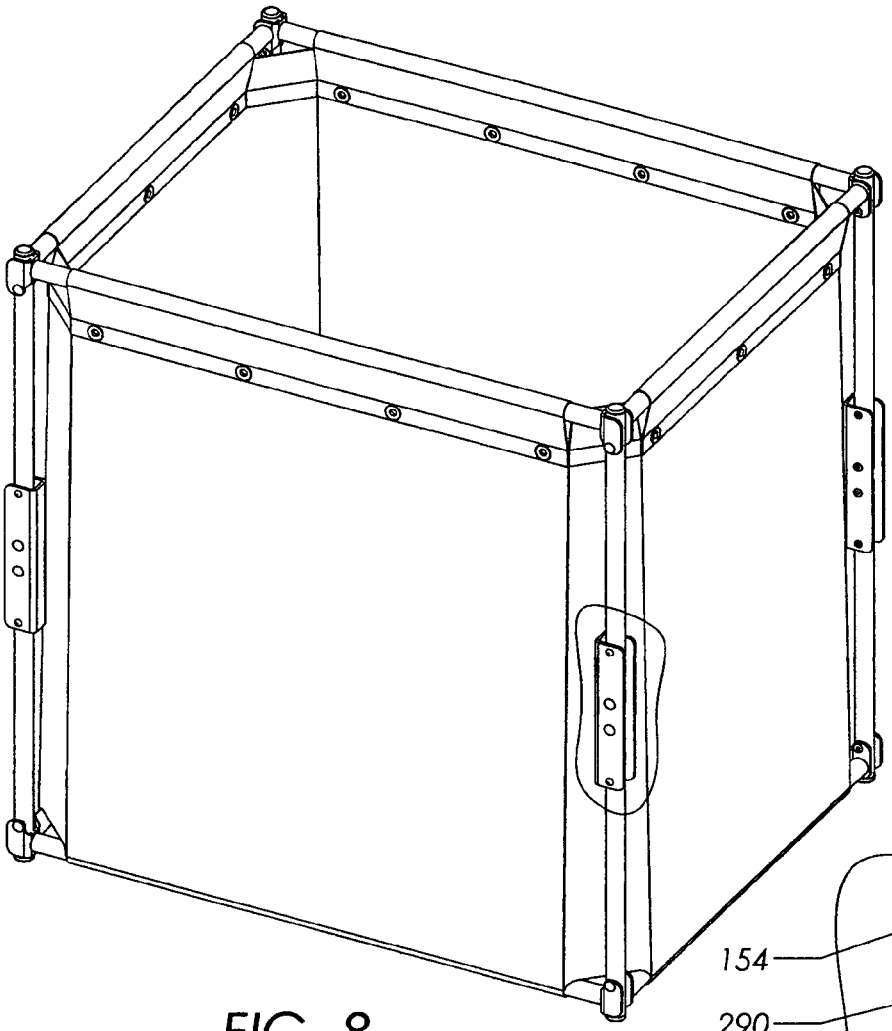
FIG. 8 is a perspective view of a second embodiment.
Figure 9:
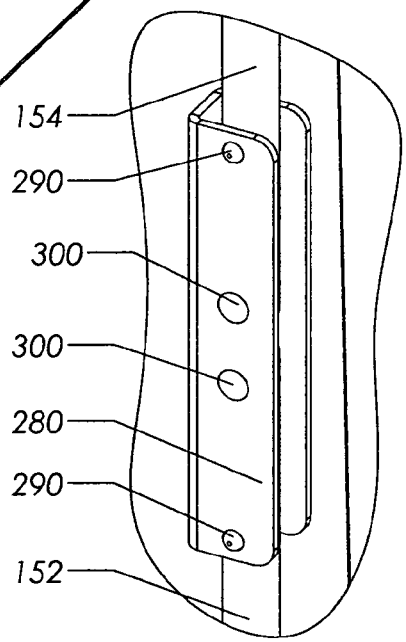
FIG. 9 is a detailed view of FIG. 8 showing a catch plate.

FIGS. 8 and 9 show a second embodiment of the invention, which is substantially similar to the first embodiment, but with an alternative system of central leg joints. In this embodiment, each lower leg (152) and upper leg (154) are attached to a common catch plate (280) by pivotable attachment means (300). To unlock the pen from its locked upright position, the supervising adult presses the spring buttons (290), which release the catch plate (280) and allow the legs to bend at the pivotable attachment means (300).

Figure 10:
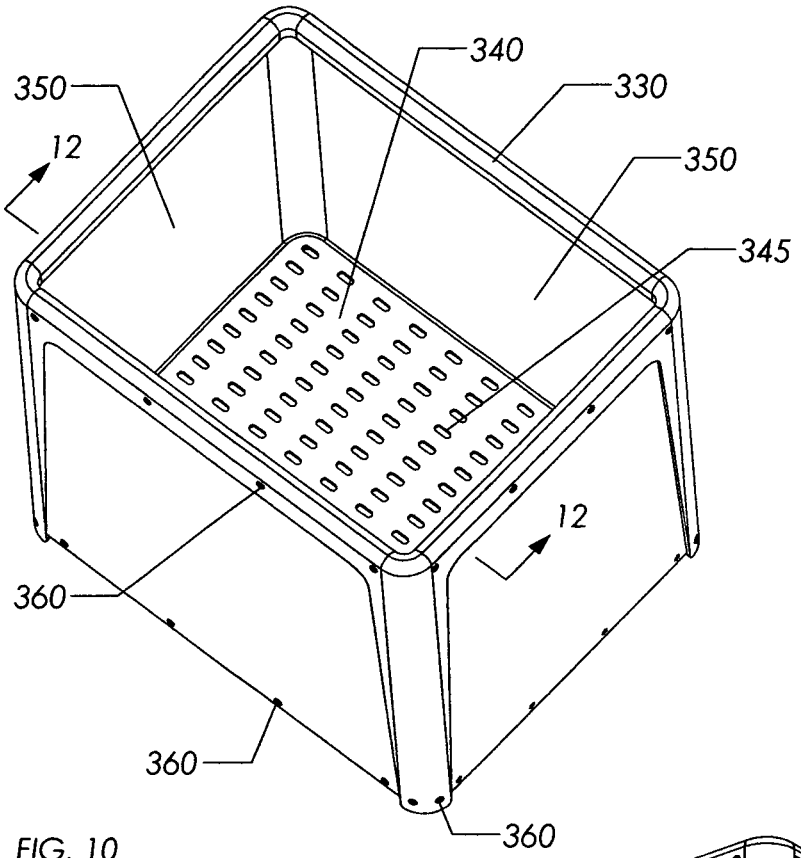
FIG. 10 is a perspective view of another embodiment.
Figure 11:
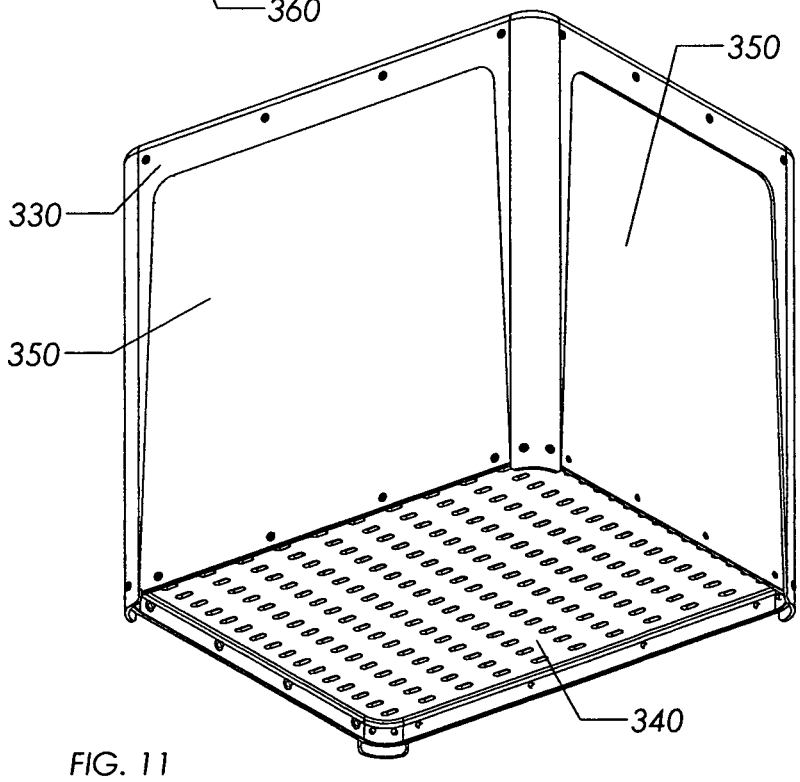
FIG. 11 is another perspective view of the third embodiment.
Figure 12:
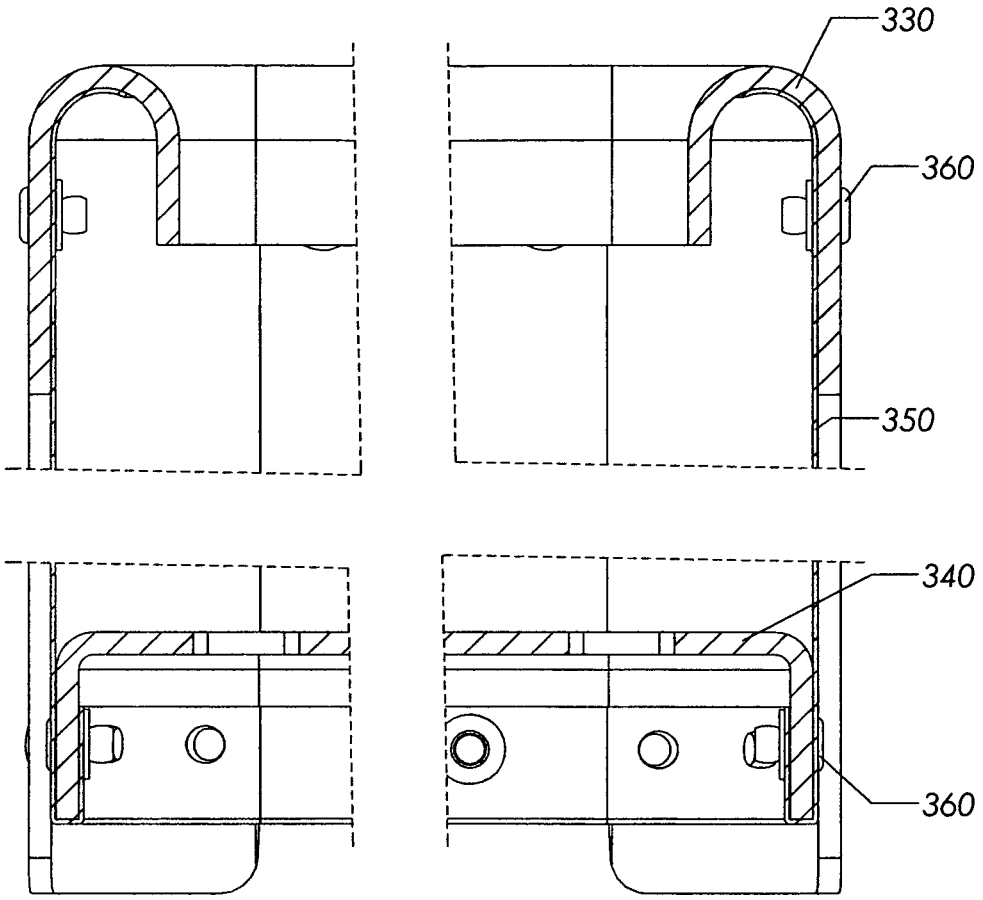
FIG. 12 is a section view of the third embodiment.

FIGS. 10-12 show a third embodiment of the invention, which is a rigid, non-collapsible structure. The primary features of this embodiment are an upper frame assembly (330), four side panels (350), and a floor panel (340). In this embodiment, the upper frame assembly (330) is a unitary molded structure of plastic or a similar material. The floor panel (340) is another unitary molded structure of plastic or a similar material, molded with perforations (345). The perforations (345) prevent pockets of air from forming underneath the pen when in use. When the pen is in storage, the slots (345) also allow for easy drainage. The side panels (350) are made of a sturdy, flexible, porous material such as mesh fabric or a similar material, as in the first and second embodiments. The primary features of the structure are secured together with rivets, adhesive, or similar fastening means (360). FIG. 12 shows a more detailed depiction of how the side panel (350) is secured to the upper frame assembly (330) and the floor panel (340) with the rivets (360). The upper frame assembly (330) is bent into an upper lip (335), allowing for a smooth handhold with no sharp edges.

Figure 13:
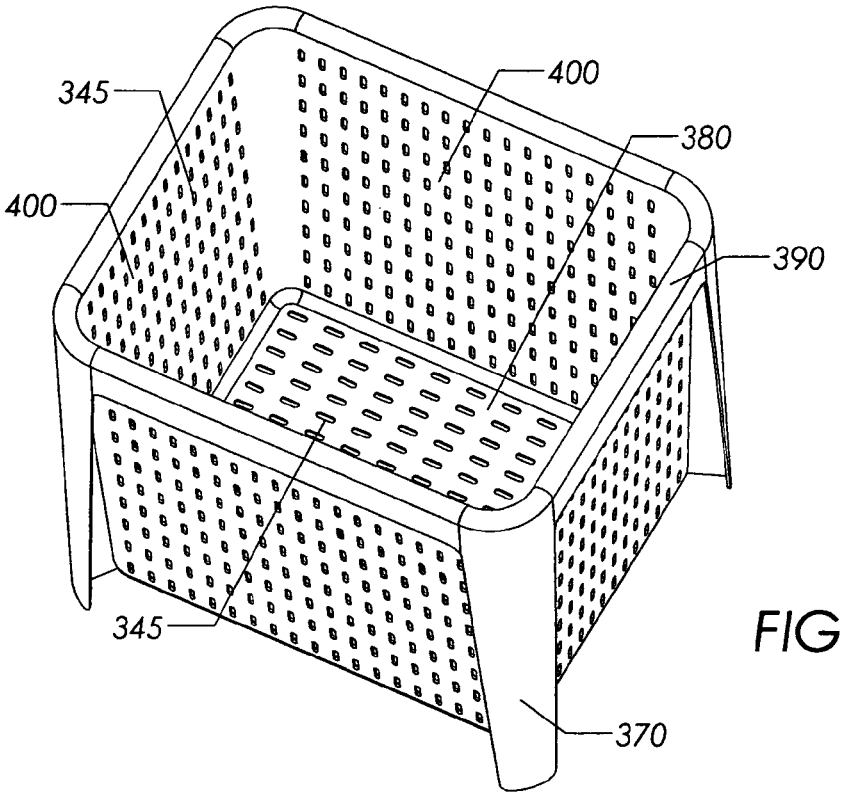
FIG. 13 is a perspective view of a fourth embodiment.
Figure 14:
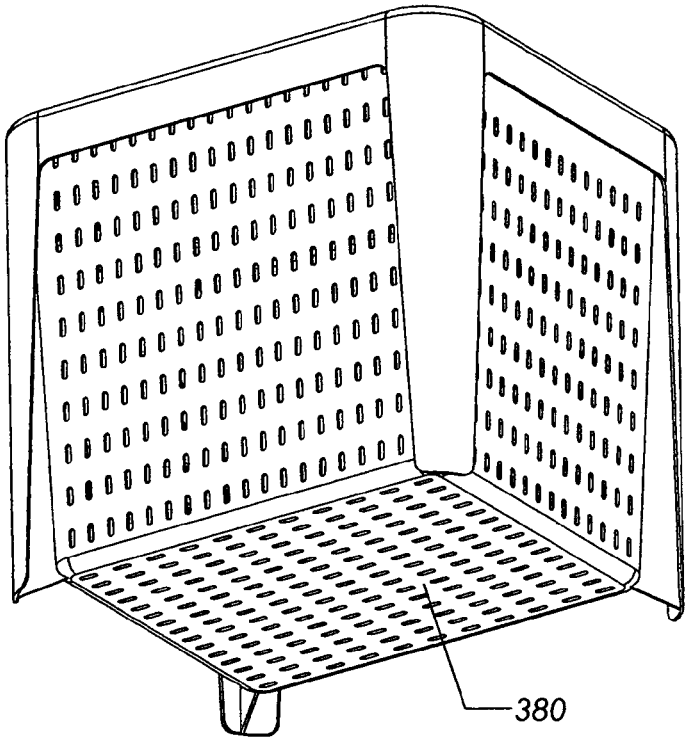
FIG. 14 is another perspective view of the fourth embodiment.

FIGS. 13 and 14 show a fourth embodiment of the invention, which is entirely a unitary molded structure of plastic or similar material. The primary elements of the fourth embodiment are the upper frame (390), side panel (400), legs (370), and floor panel (380).

The side panel (400) and floor panel (380) are molded with perforations (345). As in the third embodiment, the slots (345) prevent air from getting trapped between the underside of the floor panel (380) and water in the bathtub. The perforations (345) also allow for easy drainage and drying when the pen is not in use. The perforations (345) are too small to be used as handholds and footholds for climbing out of the pen.

White the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A pen for a bathing or showering child, comprising an enclosure to enclose a child within a standard bathtub or shower;

a lower frame assembly of rectangular shape to provide a base for said enclosure;

a floor panel attached to said lower frame assembly, said floor panel being made of a resilient material and raised above the floor of the bath or shower, and said floor panel being porous or water-permeable;

an upper frame assembly of rectangular shape and parallel to the lower frame assembly, to provide a handhold for the child and to prevent the child from climbing or falling out of the enclosure;

four legs of tubular shape, each leg affixed to one corner of the lower frame assembly and the upper frame assembly, to stabilize the pen in a standing position;

wherein each leg comprises an upper leg pivotably attached to a corner of the upper frame assembly, a lower leg pivotably attached to a corner of the lower frame assembly, a hinge plate pivotably attached to said upper leg and said lower leg, allowing said pen to collapse into a flattened position when not in use, and a tubular sleeve surrounding the joint formed where the hinge plate joins the upper leg to the lower leg, so that the pen can remain upright when in use;

a flexible, water-permeable side panel secured to the lower frame assembly and the upper frame assembly, said side panel fully enclosing the sides of the pen;

an open top.

2. A pen for a bathing or showering child, comprising an enclosure to enclose a child within a standard bathtub or shower;

a lower frame assembly of rectangular shape to provide a base for said enclosure;

a floor panel attached to said lower frame assembly, said floor panel being made of a resilient material and raised above the floor of the bath or shower, and said floor panel being porous or water-permeable;

an upper frame assembly of rectangular shape and parallel to the lower frame assembly, to provide a handhold for the child and to prevent the child from climbing or falling out of the enclosure;

four legs of tubular shape, each leg affixed to one corner of the lower frame assembly and the upper frame assembly, to stabilize the pen in a standing position;

wherein each leg comprises an upper leg pivotably attached to a corner of the upper frame assembly, a lower leg pivotably attached to a corner of the lower frame assembly, a common catch plate pivotably attached to the upper leg and to the lower leg, to lock the leg into an upright position when the pen is in use, and at least one spring button to release the common catch plate from its locked position;

a flexible, water-permeable side panel secured to the lower frame assembly and the upper frame assembly, said side panel fully enclosing the sides of the pen;

an open top.

* * * * *